United States Patent [19]

Tracy

[11] Patent Number: 4,873,750

[45] Date of Patent: Oct. 17, 1989

[54] ATTACHMENT FOR SLIDE FASTENER SLIDER PULL TAB

[76] Inventor: Richard J. Tracy, 1002 Forest Dr., Elgin, Ill. 60123

[21] Appl. No.: 143,524

[22] Filed: Jan. 13, 1988

[51] Int. Cl.[4] ..... A44B 12/26

[52] U.S. Cl. ..... 24/429; 24/431

[58] Field of Search ..... 292/318–322; 24/16 PB, 330, 664, 665, 662, 429, 431, 430

[56] References Cited

U.S. PATENT DOCUMENTS

| | | | |
|---|---|---|---|
| 1,190,552 | 7/1916 | Jalbert | 292/318 |
| 2,185,853 | 1/1940 | Knoess . | |
| 2,232,756 | 2/1944 | Marcus . | |
| 2,292,484 | 8/1942 | Schwartz . | |
| 3,558,961 | 6/1971 | Farago | 24/16 PB |
| 4,193,172 | 3/1980 | Kanzaka . | |
| 4,368,562 | 1/1983 | Minami . | |
| 4,389,758 | 6/1983 | Akashi | 24/429 |
| 4,443,916 | 4/1984 | Tiemann | 24/664 |
| 4,597,141 | 7/1986 | Wier | 24/633 |
| 4,616,953 | 10/1986 | Gomes | 24/662 X |

FOREIGN PATENT DOCUMENTS

| | | | |
|---|---|---|---|
| 2184067 | 6/1987 | United Kingdom | 292/320 |

*Primary Examiner*—James R. Brittain

*Attorney, Agent, or Firm*—Calif K. Tervo

[57] ABSTRACT

An attachment for the pull tab of a slide fastener for enhancing manipulation of the slider and for serving as an ornamental and identifying element generally comprises a clip of very hard and stiff, yet resilient, material, such as spring steel, molded into a body of soft, tactile, elastomeric material. A channel leading to the clip in the body receives the pull tab. The elastic side walls of the channel expand to accommodate pull tabs of varying sizes and stabilize the attachment on the tab. The clip has a locking tongue which projects into the channel in a direction away from the channel entrance and terminates in an engaging end for engaging and locking the tab in the channel. The engaging end is curved such that considerable pressure is exerted by its point onto the tab surface. Body material directly overlies the tongue such that deflection of the tongue also compresses and deflects the body material.

9 Claims, 1 Drawing Sheet

ATTACHMENT FOR SLIDE FASTENER SLIDER PULL TAB

BACKGROUND OF THE INVENTION

1. Field of the Invention

This invention relates to an ornamental and function-enhancing attachment to the pull tab of a slide fastener slider.

2. Background of the Invention

Slide fasteners are used on a wide variety of products such as on jackets, overboots, brief cases, and purses. Slide fasteners comprise a latch member or a set of latch members on each of the edges to be joined. The latch members are brought into engaging or disengaging positions as a result of passage through a slider. A pull tab is attached to the slider for gripping by a person to facilitate the movement of the slider. Typically, pull tabs are hingedly connected to the slider at one end.

In many instances, the conventional pull tab supplied with a product will not adequately perform its functional role of reliable manipulation of the slider. For example, it is often difficult to grasp a pull tab when wearing gloves, such as while skiing or working in the cold. Therefore, it is desirable to attach a grip enhancing and pull enhancing member to a pull tab.

It has been found that augmenting the pull tab with an soft, flexible, tactile attachment allows it to be more easily located and gripped and provides for quicker and easier manipulation of the fastener.

Slide fasteners may be required to have a pleasing appearance. Often flaps of the material joiner cover the latching members and slider so that only the pull tab is visible. In any event, it is therefore often desirable to attach an esthetically pleasing or ornamental member to a conventional pull tab.

Commonly, products bearing slide fasteners are mass produced and are indistinguishable from one another. For example several school children may have identical over-shoes or pencil cases. Therefore, it is desirable to have an identifying member that can be attached to the pull tab to distinguish one's property from another's or one item from another.

Although there is some uniformity in the pull tabs features; pull tabs vary somewhat in size, shape, and surface features, and it is not practical to make an attachment that is specifically designed to accommodate a certain design of pull tab. Therefore, it is additionally desirable to have a tab attachment which satisfies the requirements listed above and which is so constructed that it can accommodate a variety of pull tab designs.

Heretofore, various attempts have been made to construct an attachment directed toward one or more of these objectives. One such proposal is represented by an attachment that locks onto a protuberance or lateral projection on the free end of a pull tab. Such an attachment is, of course, extremely limited in that it can be used only with a specific pull tab design. Another previous form of attachment includes a body of resilient material having a slot for receiving a pull tab. A projection of the resilient material extends into the slot to lock into a hole in the pull tab. Such a device is limited to pull tabs having a hole in a given location. Only a very small range of tab thicknesses and width can be accommodated. Also, the locking projection, being made from the same resilient material as the body, tends to wear and shear with repeated manipulations of the slide fastener resulting in structural failure and disassembly of the attachment from the pull tab.

Therefore, it is desirable to have a pull tab attachment which is soft, flexible, and grip enhancing; which is reasonably universal in that it can be used with a range of tab pull sizes and designs; and which is firmly attached to the pull tab and will not easily be removed or broken.

SUMMARY OF THE INVENTION

This invention is an attachment for the pull tab of a slide fastener which enhances manipulation of the slider and also serves as an ornamental and identifying element. The attachment generally comprises a clip of very hard and stiff, yet resilient, material, such as spring steel, molded into a body of soft, tactile, elastomeric material. A channel leading to the clip in the body receives the pull tab. The elastic side walls of the channel expand to accommodate pull tabs of varying sizes and stabilize the attachment on the tab. The clip has a locking tongue which projects into the channel in a direction away from the channel entrance and terminates in an engaging end for engaging and locking the tab in the channel. The engaging end is curved such that considerable pressure is exerted by its point onto the tab surface. Body material directly overlies the tongue and contributes to the strength of the tongue's resilience and force on the inserted tab.

Other features and many attendant advantages of the invention will become more apparent upon a reading of the following detailed description together with the drawings, in which like reference numerals refer to like parts throughout.

DETAILED DESCRIPTION OF THE INVENTION

Figures 1, 2, 3, 4:
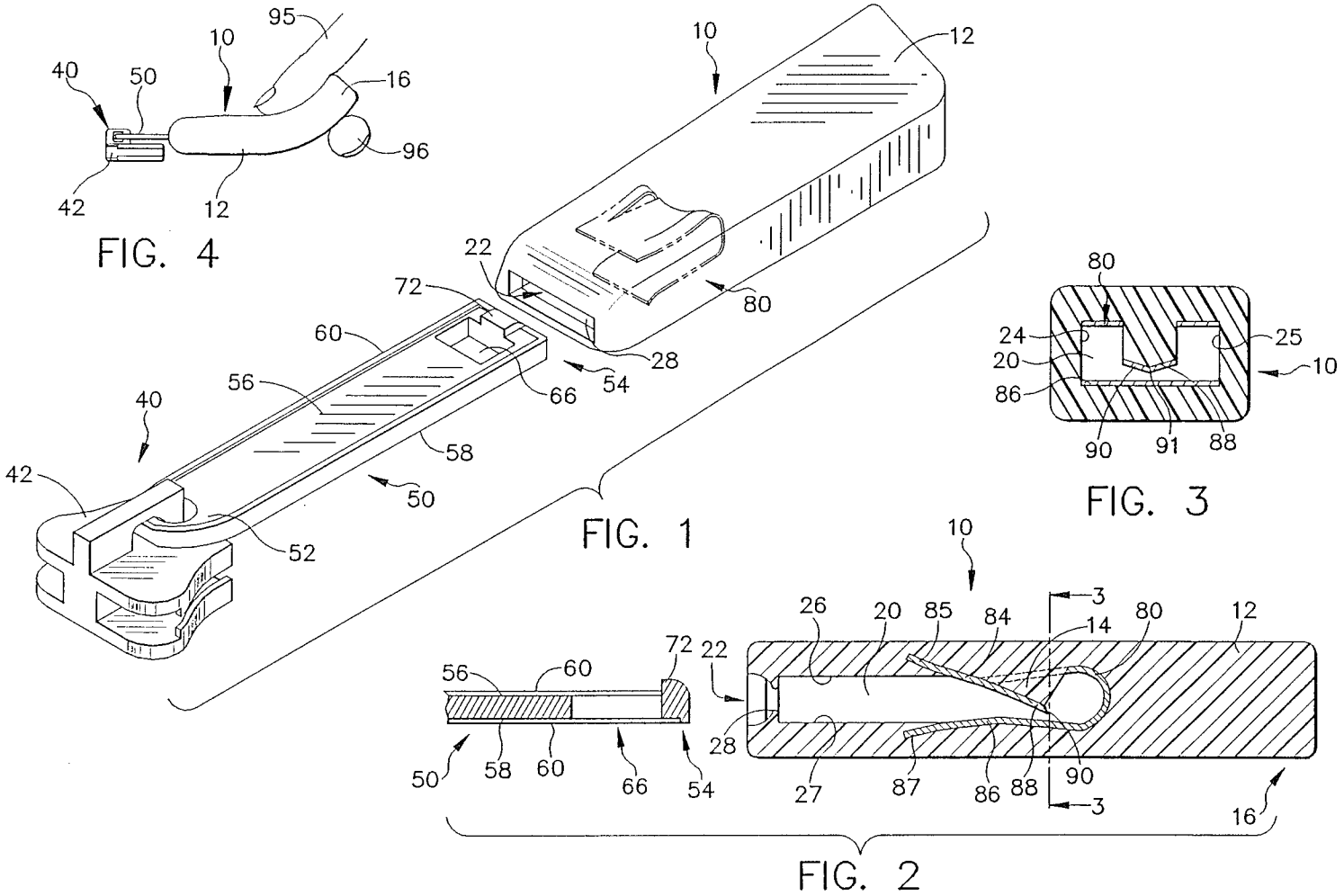
FIG. 1 is a perspective view of a preferred embodiment of the attachment of the present invention in a position for assembly with a slider pull tab.
FIG. 2 is a vertical longitudinal cross-section of the pull tab free end and the attachment of FIG. 1.
FIG. 3 is a vertical cross-section of the attachment taken on line 3—3 of FIG. 2.
FIG. 4 is a reduced side view of the attachment, as attached to a slider and pull tab assembly and manipulated by a person's fingers, illustrating the resilience and flexibility of the body.

With reference now to the drawing, and more particularly to FIG. 1 thereof, there is shown a perspective view of a preferred embodiment of the attachment, denoted generally as 10, of the present invention in position for assembly with a slider and pull tab assembly, denoted generally as 40. The slider and pull tab assembly 40 comprises a slider 42 which engages the fastener interlocking members (not shown) and a representative pull tab, denoted generally as 50. Pull tab 50 includes hinged end 52 hingedly connected to slider 42, distal or free end, denoted generally as 54, and upper and lower surfaces 56,58. Ridge or rim 60 is disposed around the periphery of the tab. Hole 66 passes through pull tab 50 near its free end 54. Lateral projection 72 is centrally located adjacent free end 54. Pull tab surface features, such as rim 60, hole 66, and lateral projection 72, can be utilized to lock an attachment onto a pull tab. Although representative pull tab 50 is illustrated and described as having the three above-named surface features, namely rim 60, hole 66, and lateral projection 72; not all pull tabs have all three features. However, as will be seen, the attachment 10 of the current invention is applicable to use with a pull tab having any one or more of such surface features.

Attachment 10 has a body 12 of elastomeric material. In the preferred embodiment, body 12 is made of tough, quite elastic, very flexible, and very tactile material such as polyurethane, silicone rubber, or thermoplastic elastomers. The importance of the body features will be more fully described later.

As best seen in FIGS. 2 and 3, body 12 surrounds a central channel, pull tab insertion channel 20. Channel 20 has side walls 24,25, top and bottom walls 26,27, and orifice 22 for receiving a pull tab. Inside channel 20 and adjacent orifice 22 is disposed sealing and stabilizing means, such as resilient lips 28. Lips 28 form a flexible collar and seal against an inserted tab for keeping water and debris from entering channel 20 and for stabilizing body 12 relative to those tabs that are thinner and narrower than channel 20.

Means for locking the pull tab in the channel, such as spring steel clip 80, is disposed in channel 20. Although a steel clip is shown in the preferred embodiment, other similar hard, strong, springy material may be used. Clip 80 is imbedded in body 12 by such means as molding body 12 around the clip.

Clip 80 includes tongue support side 84, retaining side 86, and resilient connection means for maintaining the sides 84,86 spaced in opposition across channel 20. Clip flared front sections 85,87 guide a pull tab into the clip. Front flared sections 85,87 also provide means for aiding in securing clip 80 within body 12 and preventing the clip's dislodgement from the body. Clip 80 includes means, such as tongue 88, for engaging a pull tab surface feature and thereby locking the pull tab in channel 20. Tongue 88 has one end connected to clip side 84, projects from there into channel 20 at an angle in a direction away from entry orifice 22, and terminates in engaging end 90. Tongue 88 is strongly resiliently biased in the channel intruding position shown in FIGS. 2 and 3. As best seen in FIG. 3, tongue engaging end 90 is convex relative to retaining side 86. This creates a small area of initial engagement at point 91 between the tongue and an inserted tab. A portion 14 of body 12 occupies the area into which tongue 88 is displaced upon insertion of a pull tab. In this manner, the resilience of body 12 is added to that of tongue 88. The above-described features contribute to creation of an extremely strong, highly biased locking point 91 which is capable of engaging any of the surface features mentioned or almost any other protrusion or irregularity in the surface of an inserted pull tab and of thereby locking attachment 10 onto a pull tab.

In use, pull tab free end 54 is inserted into channel 20 via orifice 22. Lips 28 deflect and slide along the tab surfaces. Resilient side walls 24, 24 stretch to accommodate and to tightly grab the tab. Tongue 88 is deflected away from retaining side 86 and engaging point 91 rides over the pull tab surface. Once point 91 passes a surface feature, the pull tab can no longer be withdrawn.

It should be noted that there is a dynamic force, in addition to the passive features mentioned above, which contributes to the pressure of point 91 on a tab and therefore to its holding ability. Tongue 88 is slanted inward, i.e. away from entry orifice 22. Therefore, an outward force on point 91 by the attempted withdrawal of an inserted tab creates a component force on point 91 in the direction of the tab surface which causes point 91 to dig in even harder and lock the tab. Due to the hardness of point 91 and its significant biasing force, in many cases it will bite into the tab surface to create its own surface feature, a retaining burr. Thus, the holding pressure of point 91 may firmly and stably attach attachment 10 to a tab in a position in which point 91 is not abutting an original surface feature.

With reference now to FIG. 4, there is shown a plane side view of an exemplary embodiment of attachment 10 connected to pull tab 50 illustrating how the soft tactile body 12 compresses under a user's fingers 95,96 to increase grip and how the distal end 16 of body 12 is disposed past clip 80 and bends even with a tab inserted, thereby enhancing manipulation of slider 42. A hole (not shown) may pass thru distal end 16 for attachment of a lanyard. A hole also increases the flexibility of the distal end and provides an indentation for gripping.

Although a particular embodiment of the invention has been illustrated and described, various changes may be made in the form, construction, and arrangement of the parts herein without sacrificing any of its advantages. Therefore, it is to be understood that all matter herein is to be interpreted as illustrative and not in a limiting sense, and the invention is to be construed as limited only by the spirit and scope of the appended claims.

I claim:

1. An attachment for the pull tab of a slide fastener slider for ornamentation and for enhancing the operation of the slider, said attachment comprising:

a body of soft, tough, very flexible, very tactile elastomeric material defining a channel for receiving the pull tab; said channel having an entry orifice at one end for entry of the pull tab; and locking means in said channel and attached to said body for locking the inserted pull tab in said channel; said locking means being of substantially harder and stiffer material than said body; said locking means comprising a spring metal clip comprising:

a tongue support side;

a tab restraining side;

resilient connecting means for connecting and maintaining said support side and said restraining side spaced in opposition across said channel; and a locking tongue having one end connected to said tongue support side and projecting into said channel toward said restraining side in a direction away from said entry orifice and terminating in an engaging end for engaging the surface of the inserted pull tab and thereby locking the inserted pull tab in said channel.

2. The attachment of claim 1 wherein:

said channel is generally rectangular in cross section and has upper, lower, and side walls.

3. The attachment of claim 1 wherein:

said tongue at said engaging end is convex relative to said restraining side such that at said tongue's closest proximity to said restraining side said tongue includes an engaging point of small area for engaging the surface of the inserted pull tab and thereby locking the inserting pull tab in said channel.

4. The attachment of claim 3 further including:

means in said channel for sealing against and stabilizing an inserted pull tab.

5. The attachment of claim 4 wherein:

said sealing and stabilizing means comprises resilient lips adjacent said entry orifice.

6. An attachment for the pull tab of a slide fastener slider for ornamentation and for enhancing the operation of the slider, said attachment comprising:

a body of soft tough, very flexible, very tactile elastomeric material defining a channel for receiving the pull tab; said channel having an entry orifice at one end for entry of the pull tab; and locking means in said channel and attached to said body for locking the inserted pull tab in said channel; said locking means being of substantially harder and stiffer material than said body; wherein said locking means comprises:

a spring clip comprising:

a tongue support side;

a tab restraining side;

resilient connecting means for connecting and maintaining said support side and said restraining side spaced in opposition across said channel; and a locking tongue having one end connected to said tongue support side and projecting into said channel toward said restraining side in a direction away from said entry orifice and terminating in a free end for engaging and locking the inserted pull tab in said channel.

7. The attachment of claim 6 wherein:

said tongue at said engaging end is convex relative to said restraining side such that at said tongue's closest proximity to said restraining side said tongue includes an engaging point of small area for engaging the surface of the inserted pull tab and thereby locking the inserted pull tab in said channel.

8. An attachment for the pull tab of a slide fastener slider for ornamentation and for enhancing the operation of the slider, said attachment comprising:

a body of soft tough, very flexible, very tactile elastomeric material defining a channel for receiving the pull tab; said channel having an entry orifice at one end for entry of the pull tab; and locking means in said channel and attached to said body for locking the inserted pull tab in said channel; said locking means being of substantially harder and stiffer material than said body; wherein said locking means comprises:

a spring clip comprising:

a tongue support side;

a tab restraining side;

resilient connecting means for connecting and maintaining said support side and said retaining side spaced in opposition across said channel; and a locking tongue having one end connected to said tongue support side and projecting into said channel in a direction away from said entry orifice and terminating in a free end for engaging and locking the inserted pull tab in said channel; and wherein said body contacts said tongue and contributes to said tongue's biased position.

9. The attachment of claim 8 wherein:

said tongue at said engaging end is convex relative to said restraining side such that at said tongue's closest proximity to said restraining side said tongue includes an engaging point of small area for engaging the surface of the inserted pull tab and thereby locking the inserted pull tab in said channel.

* * * * *